United States Patent [19]

Lounsberry, III et al.

[11] Patent Number: 4,856,617

[45] Date of Patent: Aug. 15, 1989

[54] RAILWAY LUBRICATING SYSTEM AND METHOD

[75] Inventors: Stephen M. Lounsberry, III; Peter C. Lounsberry, both of Nichols; James D. Rodems, Syracuse; Gary A. Carner, Manlius, all of N.Y.

[73] Assignee: Moore & Steele Corporation, Owego, N.Y.

[21] Appl. No.: 135,383

[22] Filed: Dec. 21, 1987

[51] Int. Cl.[4] ..... B61K 3/00

[52] U.S. Cl. ..... 184/3.1; 417/12

[58] Field of Search ..... 184/3.1, 3.2, 15.1, 184/15.2, 15.3, 7.4; 417/229, 12, 63

[56] References Cited

U.S. PATENT DOCUMENTS

| | | | |
|---|---|---|---|
| 2,238,732 | 4/1941 | Huber et al. | 184/3.1 |
| 4,214,647 | 7/1980 | Lutts | 184/3.1 |
| 4,334,596 | 6/1982 | Lounsberry, Jr. | 184/3 A |
| 4,368,803 | 1/1983 | Dombrosk et al. | 184/15 B |
| 4,738,336 | 4/1988 | Smith et al. | 184/6.4 |

FOREIGN PATENT DOCUMENTS

| | | | |
|---|---|---|---|
| 234709 | 5/1986 | Fed. Rep. of Germany | 184/7.4 |

*Primary Examiner*—Carlton R. Croyle
*Assistant Examiner*—D. Scheuermann
*Attorney, Agent, or Firm*—Watson, Cole, Grindle & Watson

[57] ABSTRACT

A method and apparatus for controlling the amount of lubricant dispensed in a railway lubricating system wherein a test cycle is effected during which lubricant is dispensed in a test amount to detect the influence of lubricant viscosity on the system, and wherein further dispensing cycles are effected to sequentially dispense an accurate and desired amount of lubricant in conformity with the detected influence of lubricant viscosity.

12 Claims, 3 Drawing Sheets

RAILWAY LUBRICATING SYSTEM AND METHOD

BACKGROUND AND SUMMARY OF THE INVENTION

This invention relates to railway track equipment and in particular to a system and method for lubrication of the flanged wheels of rolling stock relative to the track upon which they run. Such systems have been in use for many years and are exemplified, for example, by the Huber et al U.S. Pat. No. 2,238,732 of 04/14/41; the Lutts U.S. Pat. No. 4,214,647 of 07/29/80; and the Lounsberry, Jr. U.S. Pat. No. 4,334,596 of 06/15/82, the disclosures of which patents are incorporated herein by reference.

Systems of the type to which this invention is directed are plagued by the problem of controlling the precise amount of lubricant to be dispensed under all of the varying conditions encountered. For example, the lubricant itself may vary in viscosity from batch-to-batch being stored in the reservoir and this presents problems. Further, the systems are required to operate year round and under varying conditions of temperature so that the lubricant, regardless of its nominal viscosity, will display viscosity variations dependent upon ambient temperature.

Contemporarily, it is considered desirable that the lubricant usually be of relatively high viscosity, e.g., grease, in order for the proper lubrication effect be achieved and since such lubricants will display temperature-sensitivity with respect to viscosity, it is difficult, at best, to so control the lubricating system that the desired amount of lubricant is dispensed in the face of the wide range of temperature conditions to which such systems are subjected.

Accordingly, it is a principal concern of this invention to provide a railway lubricating system and method in which the desired, accurate and proper amount of lubricant is dispensed.

Another object of this invention is to provide a system as above in which the desired amount of lubricant is accurately dispensed irrespective of ambient temperature conditions.

An object of the invention resides in apparatus and method of controlling the amount of lubricant dispensed in a railway lubricating system, which comprises the steps of effecting a test cycle during which lubricant is dispensed in test amount to detect the influence of lubricant viscosity on the system, and then effecting further dispensing cycles each to dispense an accurate and desired amount of lubricant in conformity with the detected influence of lubricant viscosity.

Stated otherwise, it is of concern with respect to this invention to provide a system and method in which an initial setting is made to control the amount of lubricant which is dispensed, such set amount not necessarily being in conformity with the desired amount of lubricant required during a dispensing cycle under the temperature conditions prevailing at the time of setting, in combination with feedback means responsive to lubricant viscosity for altering the value of such initial setting to conform with the desired amount of lubricant to be dispensed under the temperature conditions prevailing at a dispensing time subsequent to the time of setting.

In accord with the above, it is of importance that the pump and drive therefor employed to dispense the lubricant be of a type which may be controlled to assure accuracy of the amount of lubricant dispensed, and that means be provided for detecting the amount of lubricant actually dispensed during a dispensing cycle to provide the necessary feedback by which the control of the pump and its drive is altered to effect dispensing of the desired amount of lubricant.

In accord with this invention, it is preferred that the dispensing pump be of the positive displacement gear type and that the drive means therefor controls the dispensing displacement of the pump, with the dispensing displacement being feedback controlled to assure accuracy of the amount of lubricant dispensed.

Stated otherwise, this invention contemplates controllable drive to a positive displacement pump for each of a sequence of lubricant-dispensing cycles with feedback, determined by the amount of lubricant dispensed during a cycle, for changing the duration of drive for a subsequent cycle in the direction of attaining the desired amount of dispensed lubricant during such subsequent cycle.

Other and further objects of this invention will become apparent as this description proceeds.

BRIEF DESCRIPTION OF THE DRAWING FIGURES

DETAILED DESCRIPTION OF THE INVENTION

Figure 1:
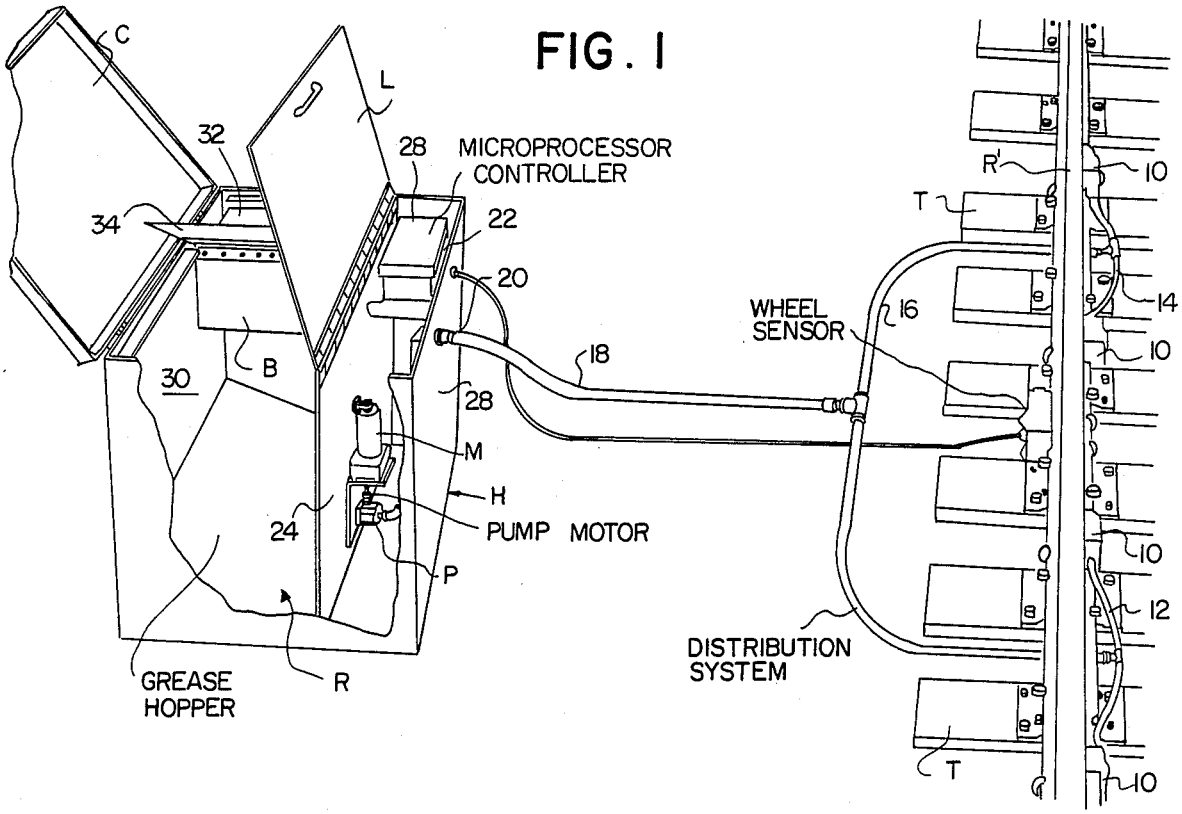
FIG. 1 is a perspective view of the system of this invention associated with a railway rail.

Referring to FIG. 1, the system of this invention is shown installed along the right-of-way of a railway system, a part of which is shown including the rail R' supported by the usual ties T to which are attached a number of lubricant applicators 10. The lubricant distribution system for these applicators includes the feed lines 12 and 14, each connected to two of the applicators and also connected with the branch feed line 16 connected as shown to the main feed line 18. The main feed line is coupled as at 20 to the lubricant outlet line 22 feeding from the pump P located on an inner wall or panel 24 of the unit housing H. The space between the walls 24 and 26 houses the microprocessor controller 28 as well as the pump P and the motor M whereas the space between the wall 24 and the rear wall 30 defines the grease hopper or lubricant reservoir R. The reservoir R is provided with a hinged lid L and also located in the space between the walls 24 and 60 is the battery box B having its own hinged lid or cover 34 and housing the battery 32. The housing is provided with the top cover or lid C.

Figure 2:
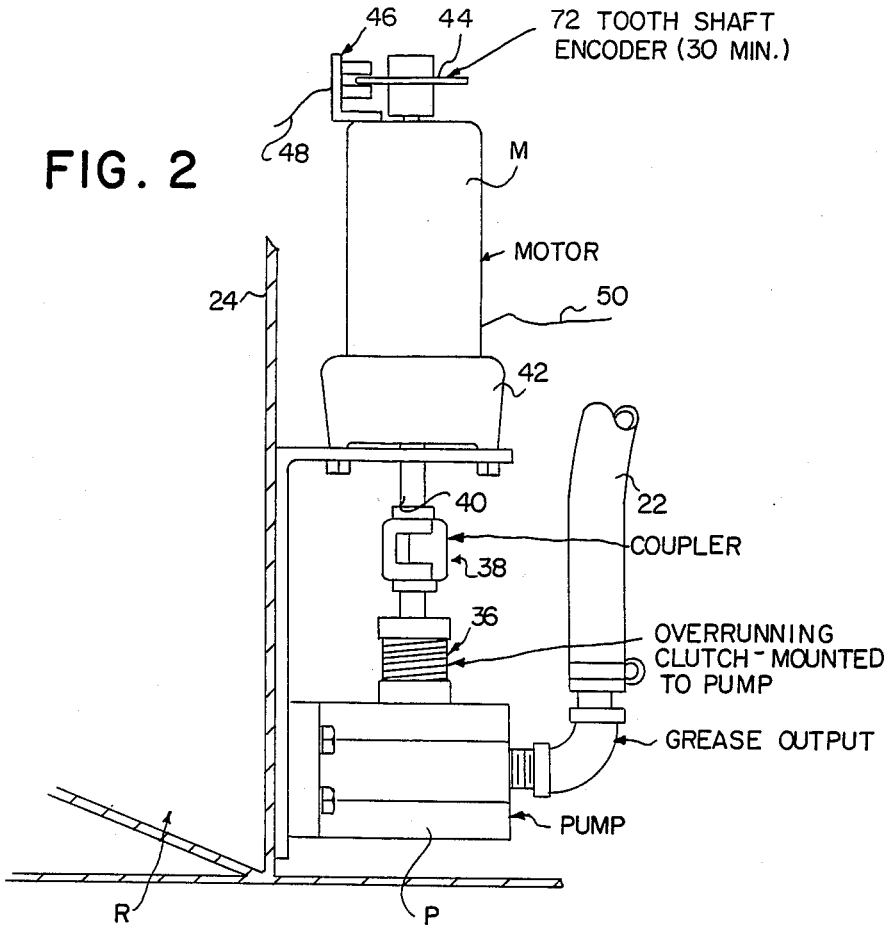
FIG. 2 is a view illustrating the pump and motor unit.

In FIG. 2, the arrangement of the pump and motor on the wall 24 is shown with it being understood that the pump includes an inlet communicating with the reservoir R. The pump P is of the well known rotary gear type and its input shaft is connected through the reversed overrunning clutch 36 and the coupler 38 to the output shaft 40 of the gear reduction unit 42 driven by the motor M. It is to be noted that the clutch 36 is mounted directly on the housing of the pump P, with the effect that whereas the motor M may transmit rotary motion to the pump P, reverse direction rotation of the pump P cannot impart reverse rotation to the motor M, but is locked against such reverse rotation by the pump housing.

Figure 5:
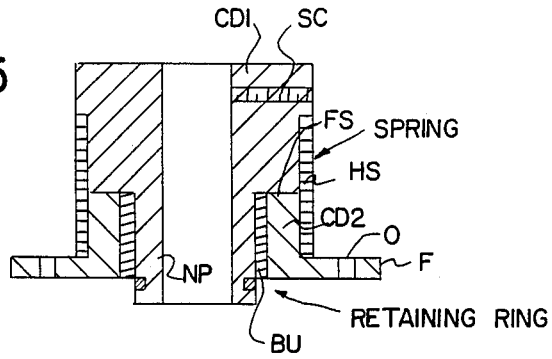
FIG. 5 is a longitudinal section through the clutch mechanism utilized in this invention.
Figure 3:
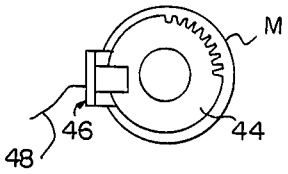
FIG. 3 is a plan view of the shaft encoder and motor.

As shown in FIG. 5, the clutch includes a drum portion CDI provided with a set screw SC which affixes this drum portion to the pump shaft PS. A second drum portion CD2 is provided with an internal bushing BU rotatably receiving the nose portion NP of the portion CD1 and the portion CD2 is provided with a flange F having openings O through which suitable fasteners are received to secure the flange to the housing of the pump P. The pump shaft PS is thus directly connected to the motor shaft 40 through the coupling 38 so that the motor is free to rotate the pump shaft in one direction of rotation. The normal operation of the clutch would be to connect the flange F to the input so that in one direction of rotation which winds the helical spring HS, the friction surfaces FS are tightly engaged to transmit torque through the flange F and the friction surfaces FS as urged into frictional contact by the winding of the spring. However, as used herein, coupling of the pump shaft PS to the motor shaft 40 is direct in one direction of rotation of the input shaft 40 but if the pump shaft attempts to reverse this direction of rotation, the clutch is so oriented that reverse rotation of the drum portion CD1 will wind the spring HS tightly to couple the two drum portions together through the friction surfaces FS and thus lock the pump shaft to the pump housing against this reverse direction of rotation.

At its upper end, the motor output shaft drives the shaft encoder 44 associated with the optical reader or encoder 46 having the output signal line 48. The shaft encoder is illustrated as having 72 teeth and since the reduction unit 42 is geared 10/1, one rotation of the pump P equals 720 rotations of the motor shaft. Thus, the optical encoder reads in units of 1/720 pump shaft rotations. The dispensing output of the pump P may be, for example, 0.041 pound of lubricant per pump shaft rotation. The motor M is powered over the line 50 under control of the microprocessor 28 as will now be described in conjunction with FIG. 4.

Figure 4:
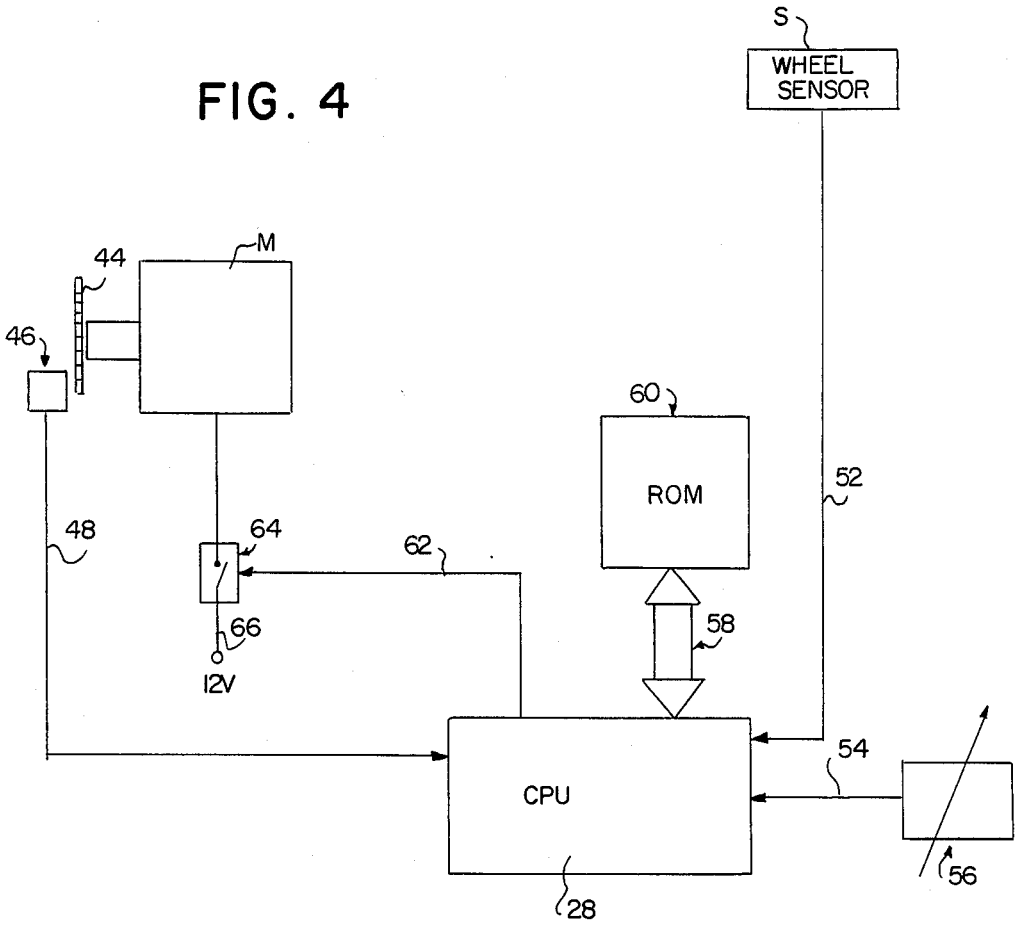
FIG. 4 is a block diagram illustrating the control system.

In FIG. 4, the microprocessor 28, which may be a type Z8681PE, is illustrated as connected with the wheel sensor S (see also FIG. 1) to receive trigger signals over the line 52, to the optical encoder 46 over the line 48, and to the setting means 56 over the address selection path 54. The microprocessor is also connected over the path 58 to the ROM 60 in which a plurality of commands are stored, some of which are addressed in accord with the setting selected in the means 56, there being further commands stored in the ROM as will become apparent presently. It is well at this point to specify the general method steps involved. Assuming that the system is in the shut-down mode so that the microprocessor 28 is turned off whereby the only current drain on the battery is that which is required to render the system responsive to an input signal from the sensor S, a first signal from the sensor S (detecting the presence of the first wheel of the train which has passed over the sensor) causes the microprocessor to power up; the second signal from the sensor S (indicating that the second wheel of the train has passed over the sensor) causes the microprocessor to execute the PILOT cycle or mode during which the motor M is powered for a period of time such that the system operates to create backpressure of lubricant in the flexible feed lines; the third signal from the sensor (indicating that the first wheel after the PILOT pulse has passed over the sensor) causes the microprocessor to execute a TEST cycle or mode during which the motor M is powered for a time which should dispense the desired and accurately correct amount of lubricant and in response to which the microprocessor monitors the number of pulses received from the encoder means 46, compares this number of pulses with the number of pulses which should be received (corresponding to the correct or desired amount of lubricant which should be dispensed) and adjusts the number of pulses to that value (which would cause the motor M to be powered for that time sufficient under the conditions present to dispense the accurately correct, desired amount of lubricant) which the system temporarily stores (in a temporary storage register in the microprocessor); the fourth signal from the sensor (and subsequent signals for the train in question) causes the number of pulses dictated by the temporarily stored signal to take control. In this regard, it is to be noted that the adjusted number of pulses which has temporarily been stored causes power to the motor M to be terminated as of the receipt of that encoder pulse which assures that the pump P will dispense the desired quantity of lubricant. It should be noted that termination of power to the motor M is commanded as of the last of the number of pulses stored.

The nominal time during which the motor M is powered in response to the TEST command is usefully based upon the ordinary or room temperature and the nominal viscosity of the lubricant in question. In this regard, the lubricant may possess a nominal low viscosity for "winter" grade lubricant, a higher viscosity for "general purpose" lubricant, and a still higher viscosity for "summer" grade lubricant. The nominal time should take into account such things as the horsepower of the motor, the gear reduction and the capacity of the pump. The inertia effects of the motor, gear reduction unit and the pump will cause some degree of "coast" subsequent to termination of power to the motor M and this, in turn will vary under actual dispensing conditions dependent upon the grade of the lubricant and the ambient temperature. That is, as ambient temperature drops, the stiffer the lubricant and consequently the slower the motor M will rotate. If the ambient temperature is too low, the lubricant may be so stiff that the motor cannot rotate, in which case the microprocessor is programmed (no encoder pulses received) to terminate power to the motor M and indicate such condition and to prevent further attempt to power the motor and thus protect it from damage. The degree of "coasting" may vary from zero or almost zero (no encoder pulses received after termination of power to the motor) to a high value of received encoder pulses, dependent upon the viscosity of the lubricant under the ambient temperature conditions prevailing.

An output path 62 of the microprocessor controls the switching means 64 to power the motor M over the line 50 from the 12 volt line 66 from the battery 32. The switching means is of solid state type and may simply be a power transistor for the DC application illustrated. It is well to point out at this time that AC operation is possible as well, in which case the battery is omitted from the system and an available AC source utilized. In this case, the AC source supplies 120 V AC power from which the necessary 5 V DC for operation of the microprocessor is obtained and, in this case, the switching means 64 may conveniently take the form of a TRIAC.

As noted above, there are further command signals which may be stored in the ROM 60 and the microprocessor is programmed to address them as necessary. One of these further stored command is PILOT. The PILOT command is addressed by the microprocessor 28 in response to the second input from the sensor S, as noted above, and the microprocessor 28 then sends a signal onto the line 62 which powers the switching means 64, and thus the motor M, for a period of, say ½ seconds. The causes the motor to drive the pump for a time sufficient to create backpressure of lubricant in the feed lines. This is important to assure accuracy of lubricant dispensing in the following sequence of commands. It is to be noted at this time that the PILOT command may be made temperature-dependent, in which case an ambient temperature sensor signal is required to be input to the microprocessor 28. The reason for this temperature dependence is that the lubricant will display increasing viscosity as temperature drops. The mentioned ½ second command to the motor has been determined to be adequate down to temperatures of about 10° F. whereas below that temperature, the PILOT command period should increased to about 10 seconds. This step change has been found to be adequate, but it is obvious that the PILOT command period may be made continuously adjustable dependent upon ambient temperature.

The second detection signal by the sensor S (next train wheel sensed after PILOT) causes the microprocessor to address that command signal stored in the ROM 60 as selected by the means 56 and this is the TEST signal command as noted above. This stored command corresponds to the number of encoder pulses which should lead to a known quantity of lubricant to be dispensed by the pump P but in fact is essentially an arbitrary value of the number of encoder pulses which will be received based upon what can be termed as a "best guess", and it is in response to this TEST command that the microprocessor 28 determines the effect of lubricant viscosity on the system via the encoder output. This is done by counting the number of pulses output by the encoder in response to this stored command. The TEST command stored in the ROM is the number of pulses programmed into the ROM corresponding to a selected setting effected by the means 56 and that number of pulses may be designated as $N_{com}$, that is, the number of pulses output by the encoder before the power to the motor is terminated. As the motor rotates, it is first doing so while power to it is on under the command of the pulses $N_{com}$ and which, due to the large gear reduction noted, will impart sufficient torque on the pump (already backpressured) that the pump will "coast" to some degree after power to the motor is terminated after the encoder feeds back a number of pulses equal to $N_{com}$, and thus cause the encoder to output a number of additional pulses, $N_{coast}$. Obviously, the number of $N_{coast}$ pulses is a measure of lubricant viscosity under the conditions then prevailing and will vary dependent upon the lubricant type and ambient temperature. The microprocessor computes $N_{com}=N_{total}-N_{coast}$, where $N_{total}$ is the number of pulses which will result in the dispensing of the accurate and desired amount of lubricant. The number of pulses $N_{com}$ is then stored in, the temporary register of the microprocessor 28 and this value $N_{com}$ is used as subsequent command outputs by the microprocessor as additional sensor outputs are received.

Pulses from the encoder are shaped so as to be of 5 volt, square wave form having a duration of about 0.01 ms so as to be readily accepted by the microprocessor.

From the above description, it is apparent that when considering an event which consists of passage of a series of railway wheels, the first wheel which is sensed causes the system to power up; the second wheel which is sensed after this powering up takes place is used to create lubricant backpressure; the next wheel sensed causes the system to determine the correct period of "power on" to the motor M; and subsequent wheels sensed cause the system to dispense the accurate and desired amount of lubricant which has been selected. In the event that the velocity of the train is so high that the passage of wheels over the sensor does not provide adequate time for a dispensing operation in response to each wheel sensed, the microprocessor is programmed to accumulate 10 such sensed wheels and defer corresponding dispensing operations for these 10 sensed wheels until such time is available for them. An available time or times may occur between the passage of a front truck of a railway vehicle and the passage of its rear truck, for example, or a total of ten dispensing cycles may be deferred until after the last wheel of the train is sensed.

The microprocessor is also programmed to shut down after a delay of 60 seconds between sensed wheels. This is done to conserve power particularly in the DC embodiment, but also to allow the PILOT and TEST operations to be performed again in the event that a sufficient period of time passes before the next wheel is sensed that temperature conditions may have changed and have rendered the computation performed during the previous TEST cycle to be no longer valid.

In considering this invention, the above disclosure is intended to be illustrative only and the scope and coverage of the invention should be construed and determined by the following claims.

What is claimed is:

1. In a rail lubricant dispensing assembly for railway systems, the combination of pump means for repetitively dispensing a desired amount of lubricant sufficient properly to lubricate between a rail and the flanged wheels of a rail vehicle irrespective of resistance offered by the lubricant to its being pumped, power means set for operating the drive means to dispense an amount of lubricant which may be different from the desired amount, control means for actuating the power means, and means for determining the actual amount of lubricant dispensed during a lubrication cycle and for adjusting the power means to alter the actual amount of lubricant dispensed during a subsequent lubricating cycle to the desired amount.

2. In an assembly as defined in claim 1 including trigger means for initially triggering the power means to dispense lubricant whereby a sequence of dispensing cycles is effected in which an early cycle backpressures the system followed by a subsequent cycle intended to dispense the desired amount of lubricant and further cycles of the desired amount of lubricant.

3. In an assembly as defined in claim 2 wherein the trigger means is mounted adjacent the track system and senses passage of a flanged rail wheel of a rail vehicle.

4. The method of controlling the amount of lubricant dispensed in a railway lubricating system, which comprises the steps of effecting a test cycle during which lubricant is dispensed in test amount to detect the influence of lubricant viscosity on the system, and then effecting further dispensing cycles each to dispense an accurate and desired amount of lubricant in conformity with the detected influence of lubricant viscosity.

5. The method as defined in claim 4 wherein the period of the test cycle is intended to correspond with the accurate and desired amount of lubricant.

6. The method as defined in claim 5 wherein the periods of the further dispensing cycles may be different from the period of the test cycle.

7. The method as defined in claim 4 wherein the periods of the further dispensing cycles may be different from the period of the test cycle.

8. The method as defined in claim 4 including the step of effecting a dispensing cycle, prior to the test cycle, which creates backpressure of lubricant in the system.

9. In a lubricant dispensing assembly for railway systems, the combination of positive displacement pump means for dispensing a desired amount of lubricant irrespective of ambient temperature conditions and viscosity of the lubricant, drive means for the pump means including mechanism for permitting the drive means to drive the pump means but not vice versa, sensor means for detecting the passage of railway rolling stock, encoding means for determining the displacement motion of the drive means, and microprocessor means connected to the sensor means, to the drive means and to the encoding means for powering the drive means during a succession of discrete periods in which the durations of such periods are varied until the desired amount of lubricant is being dispensed.

10. In an assembly as defined in claim 9 wherein the system includes lubricant applicators and feed lines connected to the applicators and to the pump means, an initial one of the discrete periods creating backpressure of lubricant in the feed lines and a subsequent one of the discrete periods dispensing an amount of lubricant which may different from the desired amount.

11. The method of controlling the amount of lubricant dispensed in a railway lubricating system which comprises the steps of powering up a microprocessor in response to detection of the passage of a leading flanged wheel of a train, creating backpressure of lubricant in response to detection of a further wheel of the train, dispensing an arbitrary quantity of lubricant upon detection of a still further wheel of the train and computing the difference between the arbitrary quantity of lubricant and a desired amount of lubricant, and dispensing lubricant less than said arbitrary amount of lubricant and adjusted progressively toward the desired amount of lubricant in response to subsequently detected wheels of the train.

12. The method as defined in claim 11 including the step of terminating power to the microprocessor in response to predetermined delay between detection of successive wheels.

* * * * *